US005611101A

United States Patent [19]

Rones

[11] Patent Number: 5,611,101

[45] Date of Patent: Mar. 18, 1997

[54] FLOOR POLISHING PAD ASSEMBLY

[75] Inventor: James M. Rones, Acworth, Ga.

[73] Assignee: Americo, Acworth, Ga.

[21] Appl. No.: 550,374

[22] Filed: Oct. 30, 1995

[51] Int. Cl.[6] ..... A47L 11/16

[52] U.S. Cl. ..... 15/230.17; 15/52; 15/230.19

[58] Field of Search ..... 15/230, 28, 52, 15/50.1, 230.12, 230.17, 230.19, 98; 451/111, 263, 532

[56] References Cited

U.S. PATENT DOCUMENTS

| | | | |
|---|---|---|---|
| 2,532,248 | 11/1950 | Upper et al. | 15/230.12 |
| 3,643,284 | 2/1972 | Patterson | 15/230.19 |
| 3,703,739 | 11/1972 | Young et al. | 15/230.17 |
| 4,437,271 | 3/1984 | McAvoy | 15/230.12 |
| 4,536,911 | 8/1985 | Demetriades | 15/230.12 |
| 4,692,958 | 9/1987 | McMakin | 15/230 |
| 4,910,826 | 3/1990 | Rones | 15/230 |
| 5,375,289 | 12/1994 | Miyaoka | 15/230 |

*Primary Examiner*—Stephen F. Gerrity
*Assistant Examiner*—James F. Hook
*Attorney, Agent, or Firm*—Sughrue, Mion, Zinn, Macpeak & Seas

[57] ABSTRACT

A composite floor pad assembly includes a pair of interchangeable and reversible floor polishing pads having identical external diameters and central openings therethrough of an identical diameter. An intermediate connecting member having a plurality of hook-like members projecting from opposite surfaces thereof and provided with a central opening is detachably connected to opposing surfaces of the two floor polishing pads. A truncated, conical mandrel is also provided over which the pads and connecting member may be placed to facilitate alignment of the pads. The mandrel may be provided with an attachment member for detachably connecting the mandrel to an upper surface of a floor polishing machine.

2 Claims, 1 Drawing Sheet

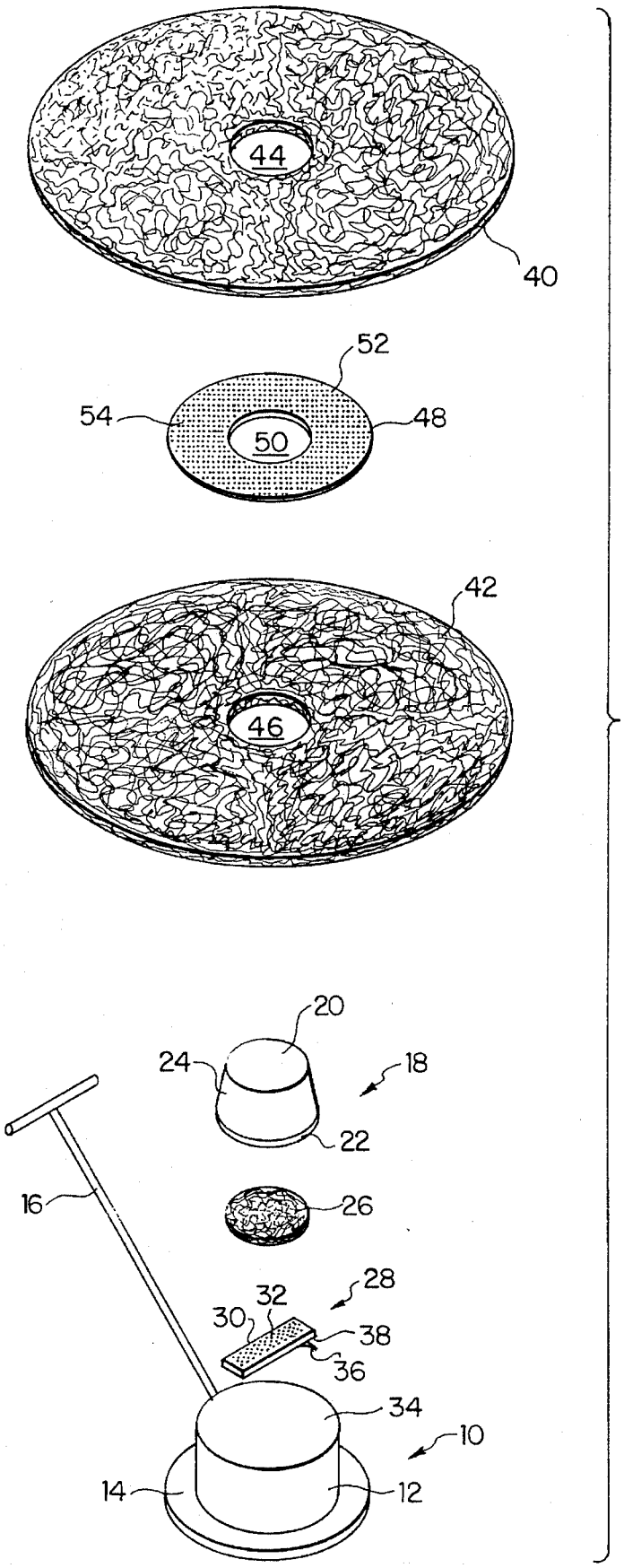
44
40
52
54
48
50
42
46
20
24
18
22
16
26
28
32
30
38
36
34
10
14
12

FLOOR POLISHING PAD ASSEMBLY

BACKGROUND OF THE INVENTION

The present invention is directed to a floor polishing pad assembly, and more specifically to a floor polishing pad for use with a floor polishing machine wherein the pad is comprised of two ⅝" thick floor polishing pads joined by a double-sided circular VELCRO disk therebetween.

Conventional floor polishing machines use a floor polishing pad which is comprised of a single 1" thick pad. The fibers of the pad do not wear down appreciably and the 1" thickness is primarily for providing cushioning so that the pad will get down into uneven ripples and dips in all floors. Although the pad can be reversed to utilize the fibers on the opposite surface, the fibers in the center of the thick pad are never used for polishing purposes but only to achieve the desired cushioning effect.

SUMMARY OF THE INVENTION

The present invention provides a new and improved floor polishing pad assembly wherein the floor polishing pad assembly is comprised of two ⅝" thick floor polishing pads interconnected by means of a double-sided circular disk having VELCRO-type hook fasteners on opposite surfaces thereof which engage the fibers of the floor polishing pads.

The floor polishing pad assembly may be shipped with the components disassembled and to facilitate assembly, a truncated, conical assembly member would be provided which is adapted to be secured to the top of a standard floor polishing machine by means of complementary VELCRO fasteners which come with the assembly member. With the truncated, conical cone placed on top of the floor polishing machine, two floor polishing pads and a double-sided VELCRO disk are placed over the conical assembly member in sequence with the tapered surface thereof aligning the pads and the VELCRO disk. After considerable use of the pad assembly, the pads may be reversed using the conical assembly member in the same manner.

The foregoing and other objects, features and advantages of the invention will be apparent from the following more particular description of a preferred embodiment of the invention as illustrated in the accompanying drawing.

BRIEF DESCRIPTION OF THE DRAWINGS

The sole Figure of the application is an exploded view of the floor polisher, detachable guide member and 3-piece interchangeable floor pad assembly.

DETAILED DESCRIPTION OF THE INVENTION

A conventional floor polishing machine 10 is shown schematically in the drawing and includes a motor housing 12, a rotatable disk-like member 14 adapted to support a floor polishing pad and a handle 16.

A truncated, conical guide or mandrel 18 is provided having a flat, circular upper surface 20, a circular disk-shaped base member 22 and a truncated, conical side surface 24 which tapers inwardly from the base member 22 to the upper surface 20. A fibrous pad 26 has a disk-shaped configuration with a diameter slightly less than the diameter of the base member 22 and it may be secured to the base member 22 by means of a suitable adhesive. An attachment member 28 is provided for securing the mandrel 18 and fibrous pad 26 to the upper surface 34 of the motor housing

12. The attachment member 28 is comprised of a VELCRO-type strip 30 having a plurality of hook-like sections 32 protruding from the upper surface thereof for engagement with the fibrous pad 26. The opposite surface of the strip 30 is provided with an adhesive covered by a removable protective strip 36. Upon peeling the protective strip 36 from the VELCRO-type strip 30, the adhesive surface 38 will be exposed and the VELCRO strip 30 can be secured to the flat, upper surface 34 of the motor housing 12 with the hook-like projections 32 extending upwardly therefrom. The mandrel 18 with the fibrous pad 26 adhesively secured to the base member 22 can then be detachably mounted on the VELCRO strip 30 by pressing the fibrous pad 26 downwardly onto the hook-like projections 32.

A pair of floor polishing pads 40 and 42 are provided. Each pad has a thickness of ⅝" and a diameter suitable to the type of floor polishing machine the pads were designed for. The pads, however, have an identical diameter and are each provided with a central opening 44 and 46, respectively, having a diameter substantially equal to the diameter of the base member 22 of the truncated, conical mandrel 18. An intermediate connector member 48 is provided having a central opening 50 with a diameter substantially equal to the diameters of the holes 44 and 46. The opposite surfaces of the disk, only one of which is shown at 52, are each provided with a plurality of projecting hook-like VELCRO-type members 54, which are detachably engageable with the fibrous pads 40 and 42.

The combination floor polishing pad comprised of the two fibrous pads 40 and 42 interconnected by means of the VELCRO-type disk 48 provide the same, if not better, cushioning than the conventional 1" thick floor polishing pad. The combination pad of the present invention however provides an additional advantage of providing four polishing surfaces, two on each fibrous pad 40 and 42. The pads may readily be reversed with respect to each other to take advantage of the four polishing surfaces provided by the composite pad and the fibrous pads 40 and 42 may readily be disassembled and reassembled in a reverse manner by using the mandrel 18, which is detachably secured to the upper surface of the floor polishing machine.

The mandrel assembly comprised of the mandrel 18, the fibrous pad 26 and the attachment strip 28, may be sold separately or may be provided in each box of ⅝" thick pads which are sold. The arrangement according to the present invention provides a more efficient packaging of polishing pads since 8⅝" thick floor pads would fit into the same box which is used conventionally to pack 5 conventional 1" thick floor pads. With five 1" thick polishing pads, the janitor gets to use both sides of five pads or ten cleaning surfaces. With the composite pad assembly according to the present invention, the janitor gets eight ⅝" thick pads and due to the reversibility of the pads, obtains 16 cleaning surfaces. This represents a 60% increase in cleaning surfaces using substantially the same total amount of material that is present in five conventional 1"thick floor pads. The tapered mandrel, which could be included in each package of floor pads, enables the janitor or floor machine operator to properly align the two ⅝ thick floor pads and the VELCRO holder to assemble the composite pad.

While the invention has been particularly shown and described with reference to preferred embodiments thereof, it will be understood by those in the art that the foregoing and other changes in form and details may be made therein without departing from the spirit and scope of the invention.

What is claimed is:

1. An interchangeable floor polishing pad assembly comprising two disk shaped floor polishing pads of fibrous material having substantially identical external diameters and an intermediate connecting disk having a smaller diameter and a plurality of hook-like members protruding from opposite surfaces thereof and detachably engaging the fibrous material of each floor polishing pad, whereby the floor polishing pads may be revised to provide four floor polishing surfaces;

wherein each pad and the connecting member are provided with central openings having identical diameters and further comprising a truncated, conical mandrel adapted to be mounted on a flat surface, said mandrel having an upper surface with a first diameter and a base member having a second diameter larger than said first diameter wherein said second diameter is substantially equal to the diameter of the opening in each pad and said connecting member to accurately align and facilitate assembly of said pads with said connecting member.

2. An interchangeable floor polishing pad assembly as set forth in claim 1, further comprising a fibrous pad secured to an under surface of said base member and an attachment member comprised of a piece of material having a plurality of hook-like members projecting from one surface thereof for engagement with said fibrous pad and an adhesive on an opposite surface for engagement with an upper surface of a floor polishing machine.

* * * * *